US010844492B2

(12) United States Patent
Ndamka et al.

(10) Patent No.: US 10,844,492 B2
(45) Date of Patent: Nov. 24, 2020

(54) COATING FOR A NICKEL-BASE SUPERALLOY

(71) Applicant: ROLLS-ROYCE plc, London (GB)

(72) Inventors: Ngunjoh L. Ndamka, Derby (GB); Paul Morrell, Swadlincote (GB)

(73) Assignee: ROLLS-ROYCE PLC, London (GB)

( * ) Notice: Subject to any disclaimer, the term of this patent is extended or adjusted under 35 U.S.C. 154(b) by 287 days.

(21) Appl. No.: 15/981,942

(22) Filed: May 17, 2018

(65) Prior Publication Data

US 2018/0334749 A1 Nov. 22, 2018

(30) Foreign Application Priority Data

May 18, 2017 (GB) ..... 1707986.4

(51) Int. Cl.

| | |
|---|---|
| ***C23C 10/02*** | (2006.01) |
| ***C23C 28/02*** | (2006.01) |
| ***C25D 5/50*** | (2006.01) |
| ***F01D 11/08*** | (2006.01) |
| ***C23C 10/28*** | (2006.01) |
| ***F01D 25/00*** | (2006.01) |

(Continued)

(52) U.S. Cl.

CPC ..... *C23C 28/023* (2013.01); *C23C 10/02* (2013.01); *C23C 10/28* (2013.01); *C23C 10/48* (2013.01); *C23C 10/60* (2013.01); *C25D 5/40* (2013.01); *C25D 5/50* (2013.01); *C25D 7/008* (2013.01); *F01D 11/08* (2013.01); *F01D 25/007* (2013.01); *C23F 1/28* (2013.01); *C25D 3/12* (2013.01); *F05D 2230/90* (2013.01); *F05D 2260/95* (2013.01); *F05D 2300/121* (2013.01); *F05D 2300/175* (2013.01); *F05D 2300/2261* (2013.01); *F05D 2300/6033* (2013.01); *F05D 2300/701* (2013.01)

(58) Field of Classification Search

CPC ..... C23C 28/023; C23C 10/48; C23C 10/60; C25D 5/40; C25D 5/50; C22F 1/10

See application file for complete search history.

(56) References Cited

U.S. PATENT DOCUMENTS

| | | | |
|---|---|---|---|
| 4,101,714 | A | 7/1978 | Rairden, III |
| 4,962,005 | A | 10/1990 | Alperine et al. |

(Continued)

FOREIGN PATENT DOCUMENTS

| | | |
|---|---|---|
| EP | 1063213 | 12/2000 |
| EP | 1693478 | 8/2006 |

(Continued)

OTHER PUBLICATIONS

European Search Report dated Jun. 4, 2018 issued in EP Patent Application No. 18168125.

(Continued)

*Primary Examiner* — Jessee R Roe

(74) *Attorney, Agent, or Firm* — Brinks Gilson & Lione

(57) ABSTRACT

An arrangement comprising a component (203) adjacent to a ceramic matrix composite in a gas turbine engine is shown. The component comprises a nickel-base superalloy substrate (301) and a cobalt-modified beta-nickel-aluminide coating (302) on the substrate to prevent interdiffusion between the substrate and the ceramic matrix composite. The substrate is coated by depositing a cobalt layer on the substrate, depositing an aluminium layer on the cobalt layer and then forming a cobalt-modified beta nickel aluminide coating.

7 Claims, 4 Drawing Sheets

(51) Int. Cl.

| | |
|---|---|
| ***C25D 7/00*** | (2006.01) |
| ***C23C 10/48*** | (2006.01) |
| ***C23C 10/60*** | (2006.01) |
| ***C25D 5/40*** | (2006.01) |
| *C25D 3/12* | (2006.01) |
| *C23F 1/28* | (2006.01) |

(56) References Cited

U.S. PATENT DOCUMENTS

| | | | |
|---|---|---|---|
| 6,080,246 | A | 6/2000 | Wing |
| 2010/0243464 | A1 | 9/2010 | Gualtieri et al. |
| 2016/0273088 | A1 | 9/2016 | Cybulsky et al. |

FOREIGN PATENT DOCUMENTS

| | | |
|---|---|---|
| EP | 2623644 | 8/2013 |
| EP | 3106620 | 12/2016 |

OTHER PUBLICATIONS

Great Britain Search Report dated Nov. 28, 2017, issued in GB Patent Application No. 1707986.4.

Fan, et al., "Microstructure and hot corrosion behaviors of two Co modified aluminide coatings on a Ni-based superalloy at 700C," Applied Surface Science, vol. 311, pp. 214-223, 2014.

Qiao, et al., "Hot corrosion behavior of Co modified NiAl coating on nickel base superalloys," Corrosion Science, vol. 33, pp. 239-245, 2012.

Rairden, et al., "A Cobalt Surface Pretreatment for Ni-Cr_Type Alloys to Attain Pore-Free Aluminized Coatings," Thin Solid Films, vol. 64, No. 2, 1979.

COATING FOR A NICKEL-BASE SUPERALLOY

CROSS-REFERENCE TO RELATED APPLICATIONS

This application is based upon and claims the benefit of priority from British Patent Application Number 1707986.4 filed 18 May 2017, the entire contents of which are incorporated by reference.

TECHNICAL FIELD

This disclosure relates generally to coatings for nickel-base superalloy components for use in gas turbine engines.

BACKGROUND

In gas turbine engines, various components are exposed to extremely high temperatures. Ceramic matrix composites (CMCs) have therefore been proposed as suitable materials with which to form such components due to their high thermal, mechanical, and chemical stability and high strength-to-weight ratio. For example, it is proposed to utilise SiC/SiC matrix composites, in which a silicon carbide matrix phase and fibre phase are combined, for seal segments form a seal ring around the turbine blades in the turbine stages of the engine.

However, problems exist in terms of provision of a suitable carrier material on to which the CMC components may be mounted. Whilst nickel-base superalloys are well-established due to their creep and oxidation performance at high temperatures, it is expected that if they are used as a carrier for CMC components that inter-diffusion of elements from the CMC (silicon in the case of SiC/SiC matrix composites) into the carrier, and nickel from the carrier into the CMC will occur. This will form a brittle intermetallic phase which could lead to component failure.

SUMMARY

There is therefore provided a method of coating a nickel-base superalloy substrate for use adjacent to a ceramic matrix composite in a gas turbine engine, the method comprising steps of: depositing a cobalt layer on the substrate; depositing an aluminium layer on the cobalt layer; and forming a beta-nickel-aluminide layer on the substrate.

There is also provided an arrangement comprising a component positioned adjacent to a ceramic matrix composite, the component comprising: a nickel-base superalloy substrate; and a cobalt-modified beta-nickel-aluminide coating on the substrate to prevent interdiffusion between the substrate and the ceramic matrix composite.

The arrangement may form part of a gas turbine engine.

BRIEF DESCRIPTION OF THE DRAWINGS

Embodiments will now be described by way of example only with reference to the accompanying drawings, which are purely schematic and not to scale, and in which.

DETAILED DESCRIPTION

Figure 1:
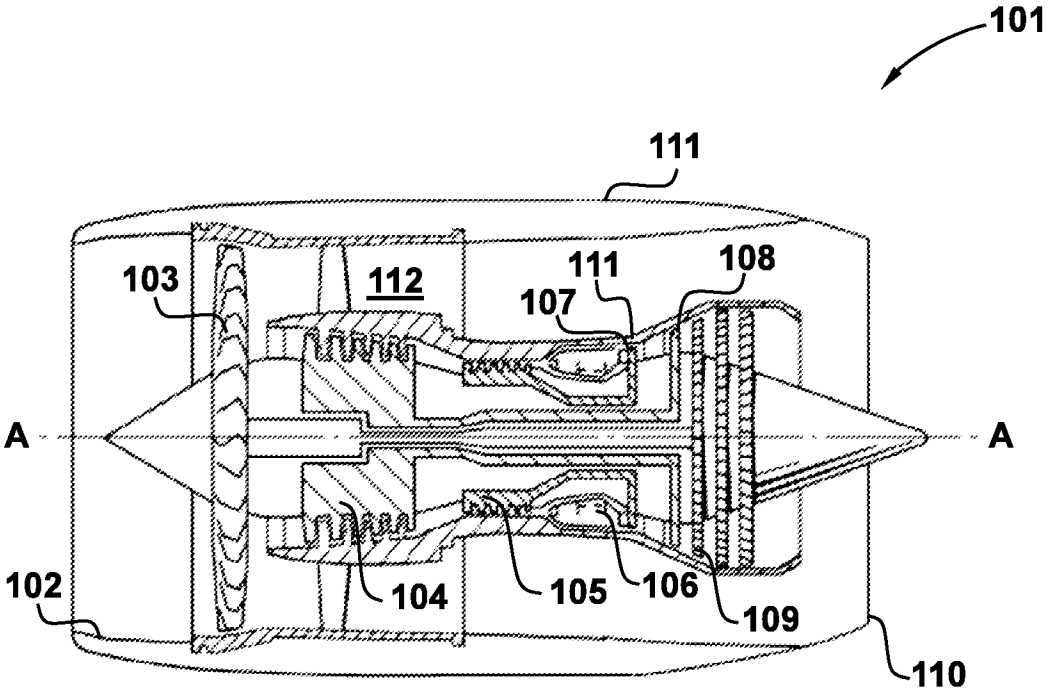
FIG. 1 shows a gas turbine engine.

A gas turbine engine is shown in FIG. 1.

The engine 101 has a principal and rotational axis A-A and comprises, in axial flow series, an air intake 102, a propulsive fan 103, an intermediate pressure compressor 104, a high-pressure compressor 105, combustion equipment 106, a high-pressure turbine 107, an intermediate pressure turbine 108, a low-pressure turbine 109, and an exhaust nozzle 110. A nacelle 111 generally surrounds the engine 101 and defines both the intake 102 and the exhaust nozzle 110.

The engine 101 works in the conventional manner so that air entering the intake 102 is accelerated by the fan 103 to produce two air flows: a first air flow into the intermediate pressure compressor 104 and a second air flow which passes through a bypass duct 112 to provide propulsive thrust. The intermediate pressure compressor 104 compresses the air flow directed into it before delivering that air to the high pressure compressor 105 where further compression takes place.

The compressed air exhausted from the high-pressure compressor 105 is directed into the combustion equipment 106 where it is mixed with fuel and the mixture combusted. The resultant hot combustion products then expand through, and thereby drive the high pressure turbine 107, intermediate pressure turbine 108, and low pressure turbine 109 before being exhausted through the nozzle 110 to provide additional propulsive thrust. The high pressure turbine 107, intermediate pressure turbine 108, and low pressure turbine 109 drive respectively the high pressure compressor 105, intermediate pressure compressor 104, and fan 103, each by a suitable interconnecting shaft.

In order to contain and direct the combustion products through the turbine stages, a casing 112 is provided. In the present example, the casing 112 comprises an arrangement according to an aspect of the present invention, which includes a component adjacent a ceramic matrix composite. In this particular example the component acts as a carrier for a plurality of ceramic matrix composite seal segments which form a sealing ring to contain the combustion products.

Figure 2:
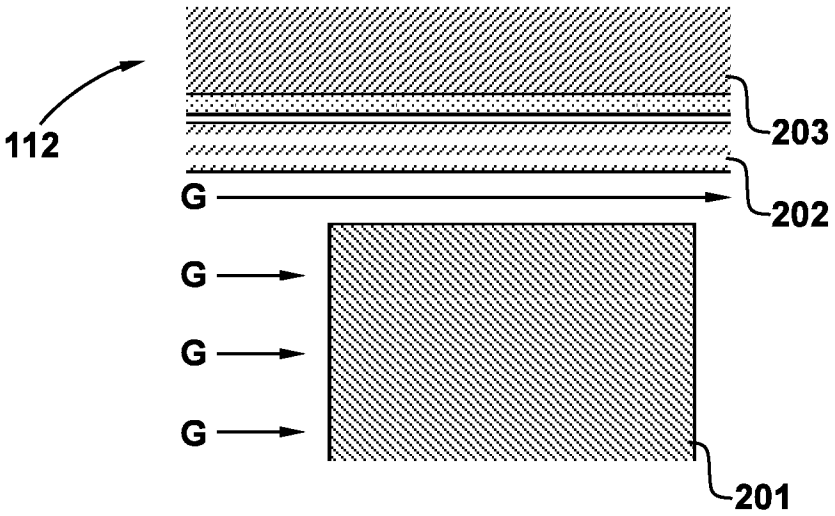
FIG. 2 shows materials in a turbine stage of the gas turbine engine of FIG. 1.
Figure 3:
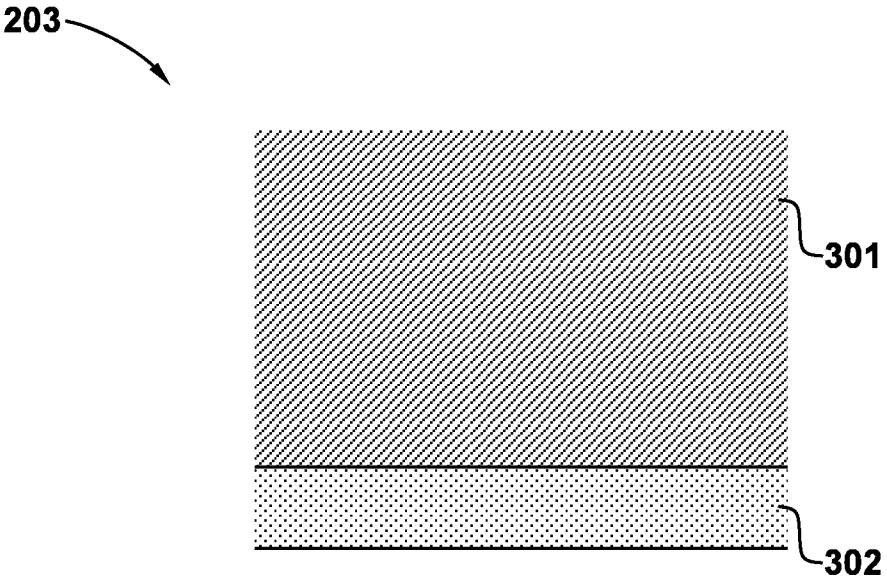
FIG. 3 shows a coated component for use adjacent to a ceramic matrix composite in a gas turbine engine.

A diagram of topological ordering of the materials in the casing 112 adjacent to one of a plurality of the turbine blades 201 of the high pressure turbine 107 is shown in FIG. 2.

As shown in the Figure, hot combustion products indicated by the arrows G flow over the turbine blade 201. They are contained by a seal ring comprising a plurality of seal segments 202 radially outward of the turbine blades 201 of the high pressure turbine 107. Lugs (not shown) on the seal segments 202 are attached by appropriate fixings (not shown) in the known manner to a carrier 203.

As described previously, the seal segments 202 of the engine 101 are composed of a ceramic matrix composite. In a specific example, the seal segments are composed of a SiC/SiC matrix composite but it is envisaged that other ceramic matrix composite may be used.

As a result of the flow of combustion products past the seal segments 202, there would be, left unchecked, a tendency for elements to diffuse into the carrier material, and vice versa.

The carrier 203 therefore comprises a substrate 301 having a coating 302 thereon. The substrate 301 is in the present example a nickel-base superalloy—it will be appreciated that the term "nickel-base" means that the superalloy has a larger proportion of nickel than any other element. Example nickel-base superalloys that may be used for the substrate 301 are C1023 and MAR M002, but it is envisaged that any nickel-base superalloy may be used.

The coating 302 operates to prevent diffusion of nickel from the substrate into the seal segment 202 during operation of the engine 101. It is also operative to prevent diffusion of elements from the seal segment 202 into the substrate 301. In the specific example of the SiC/SiC matrix composite seal segment, the coating operates to prevent silicon diffusing into the substrate 301. Thus it will be understood that the coating 302 prevents interdiffusion between the substrate and a ceramic matrix composite.

The coating 302 in the present example is a cobalt-modified beta nickel aluminide layer. It will be appreciated by those skilled in the art that the beta phase of nickel aluminide is significantly more ductile than other phases, and is therefore particularly suitable for use in the particularly hostile environment of a turbine stage of a gas turbine engine.

It has been found by the inventors that the use of cobalt as a modifier for the beta nickel aluminide coating not only provides the oxidation stability of the known platinum and chromium modifiers, but surprisingly also acts as a diffusion barrier to prevent inter-diffusion of nickel and silicon between the superalloy substrate and the SiC/SiC matrix composite. This has not been found to be the case when platinum and chromium are used as modifiers. It has also been found that cobalt unexpectedly improves the wear resistance of the coating, which again is not the case with platinum- and chromium-modified beta nickel aluminide coatings.

Figure 4:
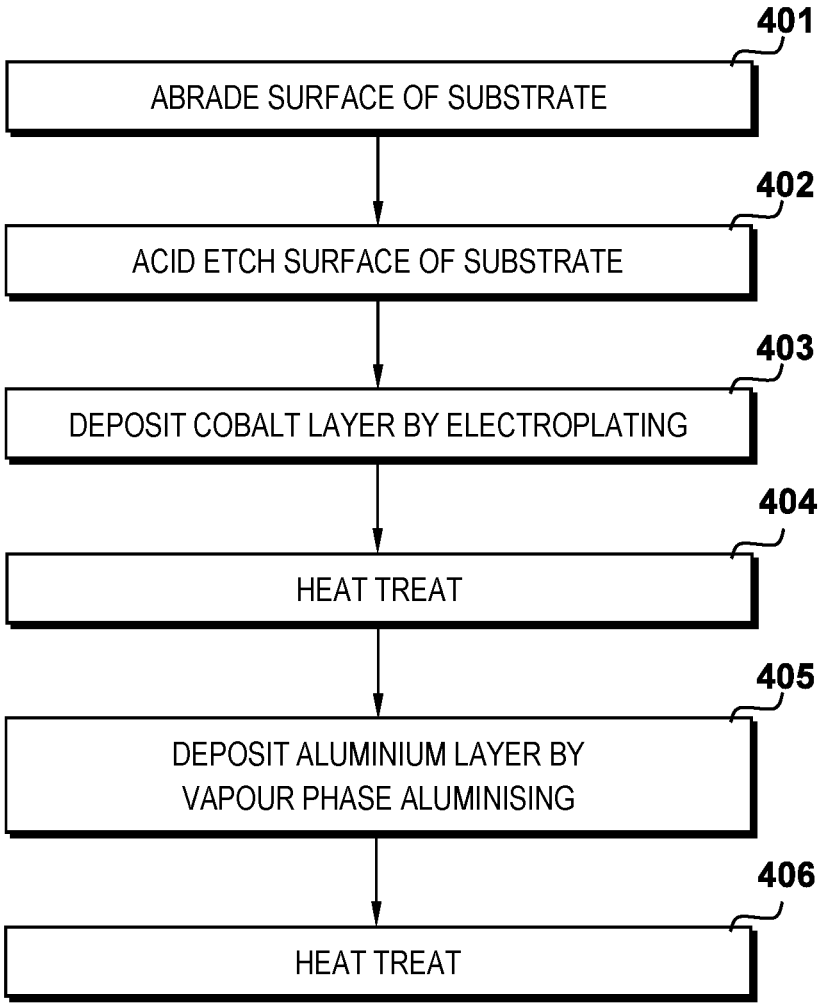
FIG. 4 shows a method of coating a component for use adjacent to a ceramic matrix composite in a gas turbine engine.

A method of forming a cobalt-modified beta nickel aluminide coating on a substrate is shown in FIG. 4, the principal steps of which are the deposition of a cobalt layer on the substrate, and subsequent formation of the beta nickel aluminide layer on the cobalt layer.

In practice, the nickel-base superalloy substrate will generally be in the form of a component such as the carrier 203 previously described. It may have therefore been cast and subjected to heat treatment, etc. As a result, and in order to optimise the adherence of the coating to the substrate, in the present example the method begins with a surface preparation procedure. This is to minimise the effect of outcropping shrinkage, porosity or segregation within the substrate which may resulting in bleed-out of entrained process solutions, and/or locally passive areas, etc.

Thus, at step 401 the surface of the substrate is abraded. In an embodiment, the surface is subjected to mechanical abrasion. This may be achieved by using an abrasive paper or cloth for example. In a specific embodiment, silicon carbide paper is used. The paper may be 240 mesh, although it will be appreciated any other suitable degree of abrasiveness may be utilised. Alternatively, or in addition, abrasive blasting may be performed to abrade the surface of the substrate. In an example, the blasting may be carried out using 120 grit media, or alternatively 220 grit media, although it will again be appreciated that alternative grit levels may be used. Following grit blasting, the substrate may be washed and scrubbed to remove residual grit, and then degreased using an appropriate degreaser such as acetone. The degreasing process may be aided by use of an ultrasonic bath, or any other suitable degreasing aid.

Following the abrasion of the surface at step 401, in the present example the surface of the substrate is subjected to acid etching at step 402 to produce a surface receptive to the cobalt layer. In an embodiment, the acid used in step 402 is ferric chloride. In another embodiment, the acid used in step 402 is hydrochloric acid. It will, however, be appreciated that other suitable acids may be used.

In an embodiment, following acid etching, the substrate is washed to remove residual etchant and/or etch products, and in a specific embodiment the washing may be completed by using demineralised water in an ultrasonic bath.

Following completion of step 402, a cobalt layer is deposited on the surface of the substrate at step 403. In the present example, this is achieved by electroplating the cobalt onto the surface of the substrate. In the present example, electroplating is performed in an electroplating bath containing a cobalt anode and a suitable electrolyte. In the present example, the electrolyte contains cobalt, and in a specific embodiment the electrolyte is cobalt ammonium sulphate. However, it will be appreciated by those skilled in the art that any suitable electroplating system may be used, such as one in which cobalt ions are only in the electrolyte and the anode is configured to be non-consumable.

In a specific embodiment, the electroplating process is initiated by applying a cobalt strike to the surface of the substrate to operate as a foundation for the remaining cobalt to adhere to by electrodeposition. In this way, a more efficient set of electroplating parameters may be used to build up the majority of the cobalt layer on the surface. It will be appreciated by those skilled in the art, however, that other methods of depositing the cobalt layer may be used, provided they give the same, similar, or improved deposition characteristics as those achieved by electroplating.

In the present example, the cobalt layer deposited on the surface of the substrate is between 2 and 4 micrometres thick. When the cobalt layer has reached this thickness, the cobalt-coated substrate is then washed and dried. In the present embodiment, demineralised water is used so as to not impart impurities, but other washing agents that will not contaminate the substrate can be used.

Following deposition of the cobalt layer at step 403, in the present example the cobalt-coated substrate is subjected to heat treatment. This is to ensure good adherence of the cobalt layer to the substrate. In a specific embodiment, the heat treatment is carried out in a vacuum.

A layer of aluminium is then deposited on the cobalt layer at step 405. In the present embodiment, this is achieved by a process of vapour phase aluminising, which will be familiar to those skilled in the art. It will be appreciated that alternative aluminisation processes including pack cementation, chemical vapour deposition may be used instead.

Finally, at step 406 the aluminised and cobalt-coated substrate is subjected to further heat treatment. This may be carried out in a vacuum. Carrying out step 406 results in the formation of the cobalt-modified beta nickel aluminide coating, by promoting inter-diffusion of nickel from the substrate towards the aluminium and vice versa, along with diffusion of the cobalt. This results in the formation of coating comprising a beta phase nickel aluminide and cobalt.

As discussed in the Examples disclosed herein, it has been found that the coating produced has about 19 percent by weight aluminium, with the balance nickel, cobalt and other elements that diffuse into the coating from the substrate. However, it is envisaged that the composition of the coating may be varied across the beta phase from hypostoichiometric to hyperstoichiometric depending on the requirements of the coating, process limitations, etc.

Thus, following step 406, the resulting component, comprising the nickel-base superalloy substrate having a cobalt-modified beta nickel aluminide coating thereon, may be arranged next to a ceramic matrix composite. In an example, this arrangement may be in a gas turbine engine, and the ceramic matrix composite may be a SiC/SiC matrix composite. In this environment, during operation of the engine, the coating surprisingly operates to prevent inter-diffusion of nickel and silicon from the component and the composite along with wear resistance, whilst retaining high performance in terms of resistance to hot corrosion, oxidation and—a set of attributes not seen with other modified beta nickel aluminide coatings.

Example 1

A sample of C1023 alloy was obtained. The sample was subjected to mechanical abrasion with 240 mesh silicon carbide paper. The sample was subsequently acid etched using ferric chloride for 1 minute, and then thoroughly washed and rinsed to ensure removal of all etch residues. The washing was completed using demineralised water in an ultrasonic bath for 2 minutes.

The sample was then placed in a bath containing an electrolyte which was a solution of cobalt ammonium sulphate, along with a wetting agent. The concentration of the electrolyte was 150 grams per litre. The anode was a rod of pure cobalt.

An initial strike was deposited by applying a current of 4 amps per square decimetre (with respect to the surface area of the sample) for 2 minutes. The electroplating process was then continued in the same solution at 2 amps per square decimetre until the thickness of the cobalt layer reached at least 2 micrometres. (In this example, 2 minutes was required but in other experiments up to 6 minutes was required.)

Following the deposition of the cobalt layer, the sample was thoroughly rinsed in demineralised water, and then dried. The sample was then heat treated at 1100 degrees Celsius for 1 hour. Vapour phase aluminisation was then carried out for 4 hours at 1040 degrees Celsius, with post-aluminisation vacuum heat treatment then being carried out at 1100 degrees Celsius for 1 hour.

The coating obtained was verified as being a beta nickel aluminide with a composition by weight of Ni: 59.15 percent; Co: 15.26 percent; Al: 19.06 percent; Cr: 5.31 percent; Ti: 1.22 percent—the chromium and titanium content being a result of diffusion from the C1023 substrate during the post-aluminisation heat treatment process.

Example 2

A sample of C1023 alloy was obtained. The sample was subjected to abrasive blasting with 120 grit media. A washing procedure was then carried out with the sample being scrubbed to remove any residual grit. The sample was then degreased using acetone in an ultrasonic bath.

The sample was subsequently acid etched using hydrochloric acid for 1 minute. The remaining process steps subsequently carried out were the same as for Example 1, with a similar result.

The invention claimed is:

1. An arrangement comprising a SiC/SiC matrix composite;

a component positioned adjacent to the SiC/SiC matrix composite, the component comprising a nickel-base superalloy substrate; and a cobalt-modified beta-nickel-aluminide coating on the substrate to prevent interdiffusion between the substrate and the SiC/SiC matrix composite.

2. A gas turbine engine comprising the arrangement of claim 1.

3. The gas turbine engine of claim 2, in which the ceramic matrix composite is a seal segment for a turbine stage of the engine, and the component is a carrier for the seal segment.

4. A gas turbine engine comprising an arrangement comprising:

a ceramic matrix composite;

a component positioned adjacent to the ceramic matrix composite, the component comprising a nickel-base superalloy substrate;

a cobalt-modified beta-nickel-aluminide coating on the substrate to prevent interdiffusion between the substrate and the ceramic matrix composite, wherein the ceramic matrix composite is a seal segment for a turbine stage of the engine, and the component is a carrier for the seal segment.

5. An arrangement comprising:

a ceramic matrix composite comprising a matrix phase and a fiber phase;

a component positioned adjacent to the ceramic matrix composite, the component comprising a nickel-base superalloy substrate; and a cobalt-modified beta-nickel-aluminide coating on the substrate to prevent interdiffusion between the substrate and the ceramic matrix composite.

6. A gas turbine engine comprising the arrangement of claim 5.

7. The gas turbine engine of claim 6, wherein the ceramic matrix composite is a seal segment for a turbine stage of the engine, and the component is a carrier for the seal segment.

* * * * *